United States Patent [19]

Schenk

[11] Patent Number: 4,778,399

[45] Date of Patent: Oct. 18, 1988

[54] MULTI-SERVICE ELECTRICAL OUTLET MODULE

[76] Inventor: Peter Schenk, 2929 SE. Ocean Blvd., Stuart, Fla. 33494

[21] Appl. No.: 14,604

[22] Filed: Feb. 13, 1987

[51] Int. Cl.[4] ..... H01R 13/44

[52] U.S. Cl. ..... 439/147; 174/48; 439/538

[58] Field of Search ..... 174/48; 339/36, 39, 339/123, 126 R, 154 R, 157 R, 147 R, 147 P; 439/131, 135, 142, 147, 528, 529, 533, 535, 538, 544, 571, 573, 638, 639, 650, 653, 654

[56] References Cited

U.S. PATENT DOCUMENTS

| | | | |
|---|---|---|---|
| 1,628,399 | 5/1927 | Frankel . | |
| 1,857,079 | 5/1932 | Cook . | |
| 2,385,620 | 9/1945 | Fleckenstein | 177/311 |
| 2,411,018 | 11/1946 | Benander | 173/338 |
| 2,828,394 | 3/1958 | Mayzik | 200/168 |
| 3,045,080 | 7/1962 | Frantz et al. | 200/51.02 |
| 3,110,753 | 11/1963 | Witort | 174/65 |
| 3,110,754 | 11/1963 | Witort et al. | 174/70 |
| 3,303,264 | 2/1967 | Saul et al. | 174/48 |
| 3,622,945 | 11/1971 | Winston et al. | 339/122 |
| 3,711,817 | 1/1973 | Carter et al. | 339/126 R |
| 4,355,853 | 10/1982 | Kourimsky | 339/122 |
| 4,451,108 | 5/1984 | Skidmore | 339/123 |
| 4,519,657 | 5/1985 | Jensen | 339/39 |
| 4,545,632 | 10/1985 | Maier et al. | 339/157 R |
| 4,559,410 | 12/1985 | Hostetter | 174/48 |
| 4,603,229 | 7/1986 | Menchetti | 174/48 |
| 4,642,418 | 2/1987 | Menchetti | 174/48 |

*Primary Examiner*—Gil Weidenfeld
*Assistant Examiner*—Paula A. Austin
*Attorney, Agent, or Firm*—Hoffmann & Baron

[57] ABSTRACT

A multi-service electrical outlet module which combines at a single outlet location, the outlets required for making connection to various electrical systems such as power, telephone, computer systems, television antenna etc.

25 Claims, 6 Drawing Sheets

16
17
74
14
20
75
74
30
99
74
24
28

Fig. 5a
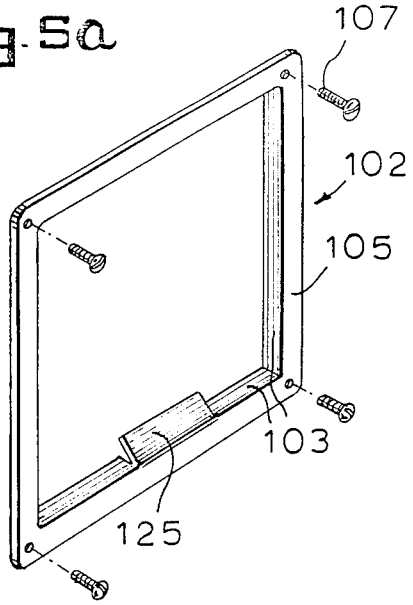
Fig. 5b
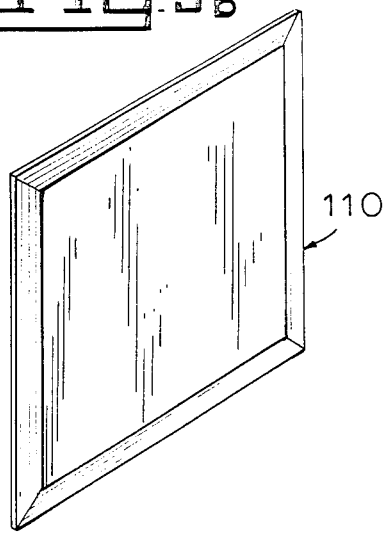
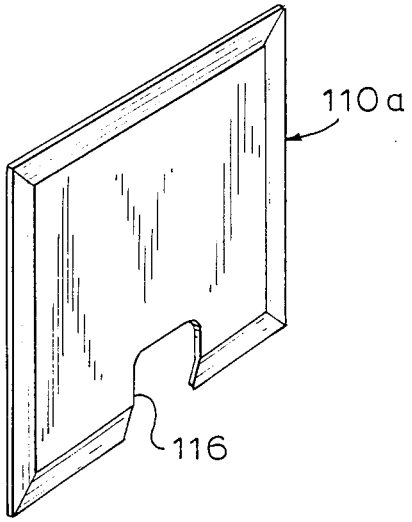
Fig. 5c
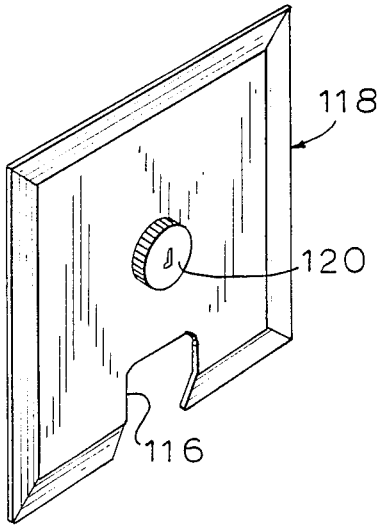
Fig. 5d

MULTI-SERVICE ELECTRICAL OUTLET MODULE

BACKGROUND OF THE INVENTION

The use of various and specific end purpose electrical systems and devices in business and industry has grown considerably in recent years. This is also true in regard to increased electrical systems and devices usage in the home. This has resulted in requirement that there be a greater number of access points for operation of electrical equipment. Thus numerous power outlets have been disposed in home for making connection with lighting, heating, air conditioning, kitchen appliance etc. components. At the same time outlets are needed for other types of electrical based systems such as telephones, televisions, computers, audio-speaker systems, security devices etc. This growth of plural numbers and separately present outlets in the home has given rise to certain disadvantages relating aesthetic and safety considerations. All these outlets are accessible to, and visible to the occupants of the home. The result is such outlets in quantity can be unsightly and, in many ways, dangerous and/or subject to being mishandled by children and others.

Patents which disclose receptacles with outlets for two different types of service connections or connectors include U.S. Pat. No. 1,628,399 showing a receptacle for use with two different shape plugs but plugs used for the same house power purpose, U.S. Pat. No. 2,411,018 showing two in-line receptacles for power and a lamp socket, U.S. Pat. No. 1,857,079 showing a receptacle for a power plug and a radio connection, U.S. Pat. No. 3,110,753 which describes an outlet for power along with one for a telephone jack in the same receptacle, and U.S. Pat. No. 4,451,108 showing a receptacle with outlets for power and one for a computer jack.

SUMMARY OF THE INVENTION

The present invention consolidates in one module configuration a plurality of electrical service outlet receptacles of diverse types and associated with diverse electrical service connections and requirements. In this manner the outlets required for different household needs, e.g., power for a lamp, telephone jack connection, computer connection etc. are located at a common point, the receptacles are readily accessible, visual appearance of a space is enhanced by eliminating plural receptacle locations in favor of one that combines in a recessed but accessible manner connections for many services.

In accordance with the invention, the module is comprised of a housing having an access opening therein, the access opening generally defining the expanse of a centrally disposed space or chamber within the housing that serves as the receptacle location space, the remainder space of the housing being employed for installation of devices and/or components other than receptacles used in the system installations. Fixed within the housing in the central chamber space are mounting plates which carry the diverse use outlet receptacles. These receptacles will include ones for reception of the connectors of electrical service cables associated with high voltage power supply, ribbon wires, telephone service, radio wave signal reception, coaxial cable service etc. Conveniently at least some of the receptacles in the plurality of such will be arranged in a grouping of receptacles but preferably the receptacles will be arranged in at least two groups thereof, one group fixed on one mounting plate and the second group fixed in a second mounting plate. This grouping of the receptacles facilitates connection of wiring, designation of insert location for specified service uses etc. The mounting plates can be disposed to have one end of each situated adjacent one of two opposite ends of the access opening and the plates can converge toward the rear of the housing. In this manner, all of the receptacles have a facing relationship with the access opening therefore being readily accessible for insertion therein of connectors on the ends of electrical service cables passed through the access opening for that purpose. Also the receptacles are most easily positioned to be disposed with some remoteness to the access opening.

The groups of receptacles can be comprised such as to simplify the multi-service character of the module. Thus in an application where need for high voltage power supply connections will predominate, all of the receptacles of one group can be associated with that service and be arranged on one side of the access opening to the convenience of the user when making such a service connection. The other group can contain other types of receptacles and in keeping with the multi-service flexibility provided by the invention, at least one receptacle in said other group will be associated with a service requirement different than that of the others. The said other group desirably will feature receptacle differences which will enable the user to readily make connections for a television antenna cable, one or more telephones, intercom system components, computer terminal service, alarm system etc. A further embodiment includes a ribbon wire receptacle mounted within the central chamber on a panel bridging the inner or rearwardly located ends of the receptacle mounting plates although it will be understood that ribbon wire connectors also could be present in one of the two groups described aforesaid.

The exact numbers, types and placement of the various outlet receptacles can be varied to suit particular present and anticipated household electrical system needs for a particular house space, i.e., modules used in a kitchen environment generally will differ in outlet make up from one to be used in a bathroom.

The module conventionally will be designed to fit in a wall space being secured to a mounting structure such as a wall stud with the housing opening flush with or protruding only a slight distance from the wall outer surface. Suitable attachment means such as tabs can be embodied on the housing.

The housing will as is commonly the practice, be installed on framing before the wall members are erected on the framing, and all wiring connections to the receptacles desirably will have been made so that the only module structure showing after wall surface installation will be the access opening and a narrow retainer plate surrounding the access opening.

The invention also provides that a closure plate can be removably secured to the housing in covering position over the access opening. In the circumstance where no cables are connected to outlets in the module, the closure plate can effect solid close-off of the module access opening. Where cables are connected and pass through the access opening, the closure plate may be in an embodiment thereof which has a marginal recess for accommodating cable pass through while the remainder of the opening is covered. The closure plate can be removably secured to the module in various manners. It may, e.g., snap fit into the access opening, it may be retained on the module by screws or it may include a key operated lock thereon to preclude unwanted or unauthorized entry to the module outlets.

The invention accordingly comprises the features of construction and arrangements of parts as embodied in the multi-service electrical outlet module as will be exemplified in the description hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Figure 7:
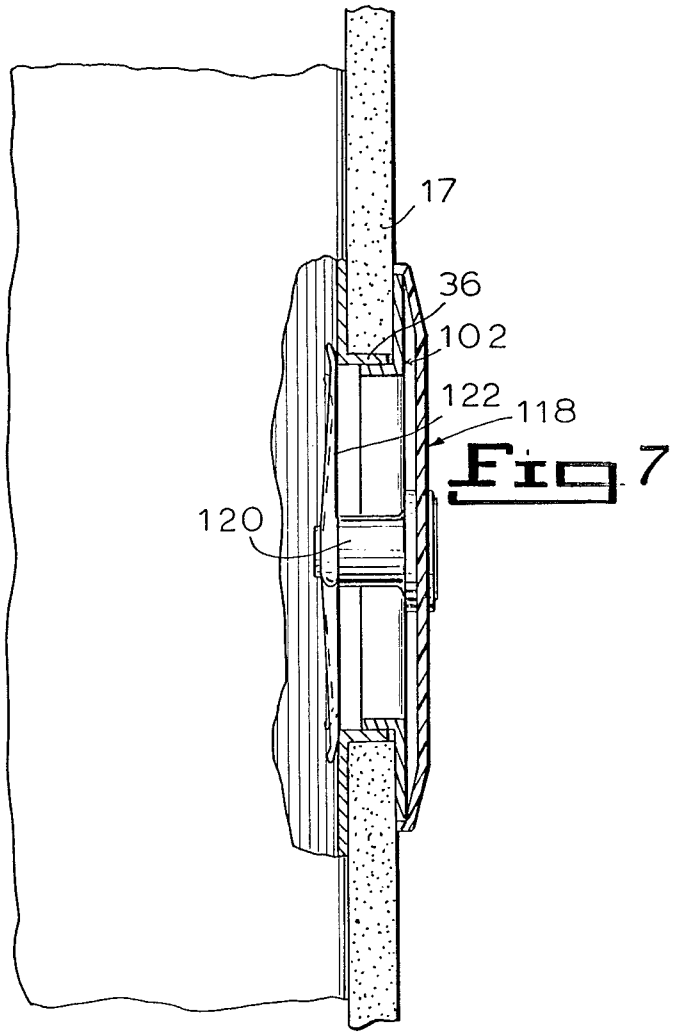
Figure 8:
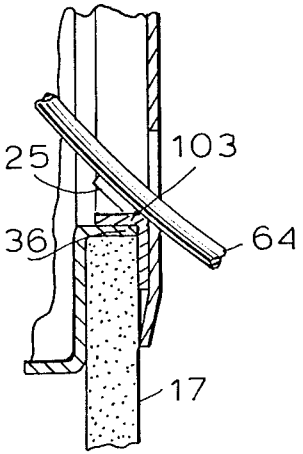
Figure 6:
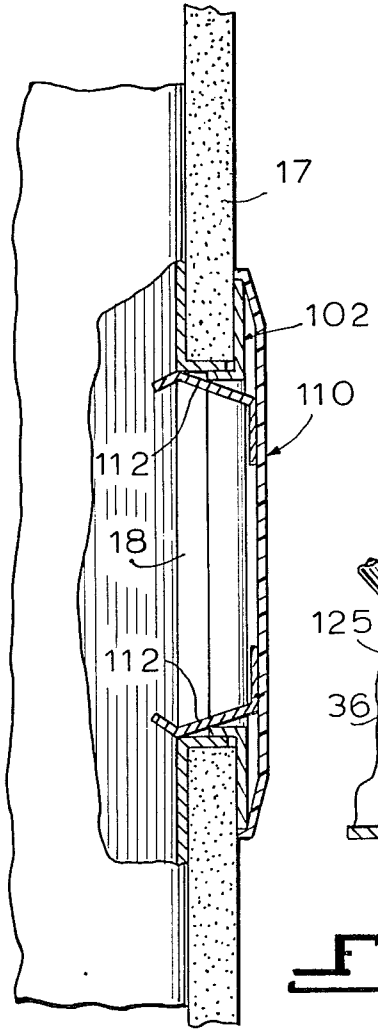

FIGS. *5a–5d* are perspective views on reduced scale showing respectively, a retainer plate which surrounds the access opening and is secured to the front wall of the module with the wall board sandwiched therebetween, and three forms of removable bezels or closure plates which can be used to close off the module access opening;

FIG. 6 is a fragmentary sectional view showing how one of the three closure plates is snap fit into the housing for closing off the access opening;

FIG. 7 is a fragmentary view similar to FIG. 6 showing the use of a key lock closure plate for access opening close off; and FIG. 8 is a fragmentary sectional view showing the manner in which a saddle on the retainer plate cooperates with the marginal recess of the FIGS. *5c, 5d* closure plates to effectively block viewing of the module interior.

Throughout the following description, like reference numerals are used to denote like parts in the drawings.

DESCRIPTION OF THE PREFERRED EMBODIMENTS

Figure 1:
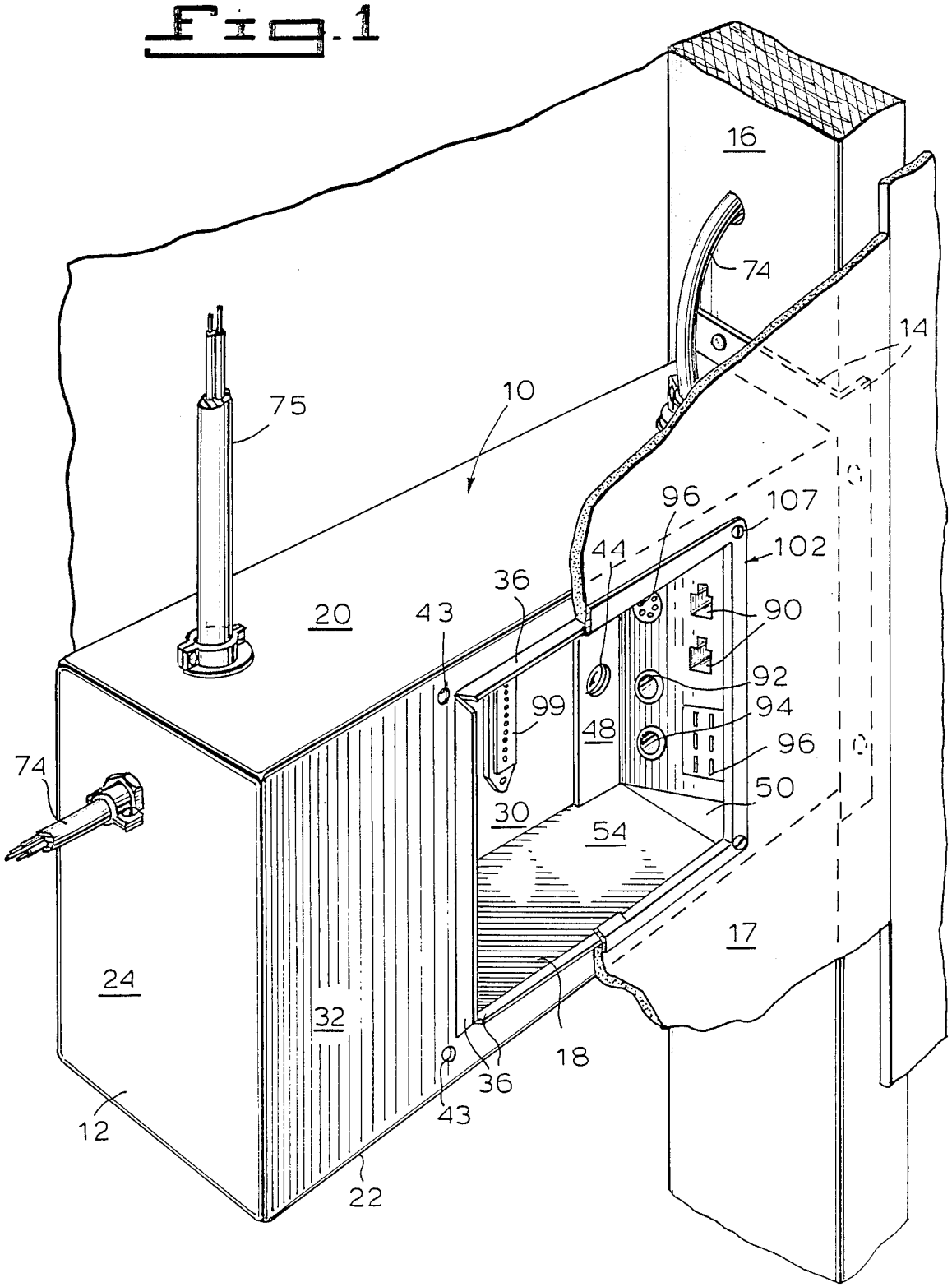
FIG. 1 is a fragmentary perspective view of a house wall structure showing an outlet module of the invention mounted therein, the module being seen from the front or access opening side thereof.
Figure 2:
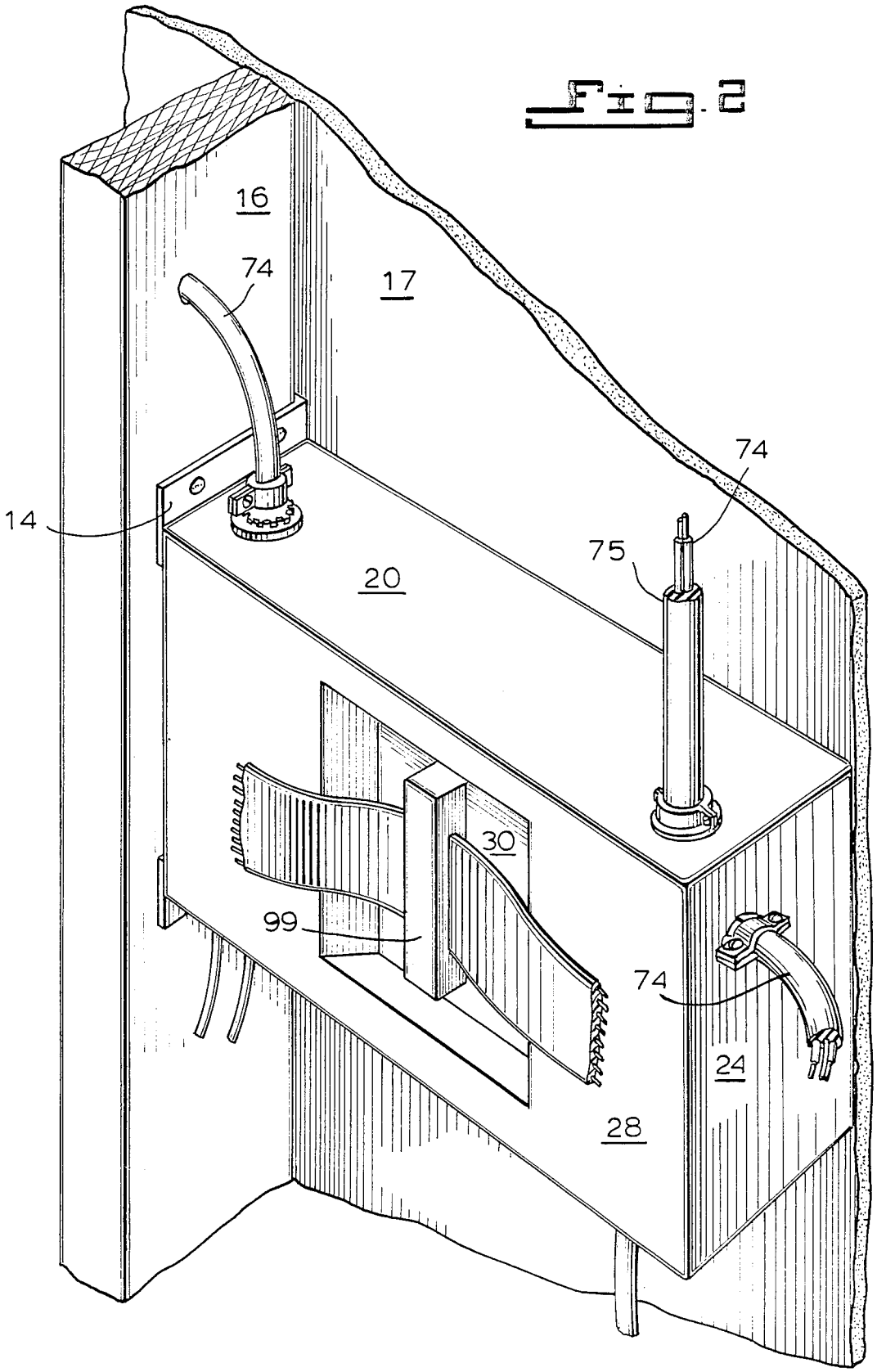
FIG. 2 is a view similar to FIG. 1 but as viewed from the rear of the module and depicting further the mounting of a ribbon wire receptacle on the rear of the housing.

FIGS. 1 and 2 show the general use environmental space mounting of the outlet module 10 of the present invention. The environmental space could be any one of the several room spaces of a home wherein need for multi-purpose service electrical systems supply exists such as a kitchen, recreation room etc. It also could be an office space in a business or commercial location. The actual physical positioning of the module structures will be made in accordance with space availability and proximity of systems and devices to be connected thereto.

As shown in FIGS. 1 and 2, the outlet module 10 is a structure 12 of housing form, depicted as of rectangular geometry but other housing configurations also could be used. The housing 12 will include means thereon such as perimeter tabs 14, slotted or otherwise apertured to allow fastener pass through for effecting securement of the housing to structural components such as wall studs 16 or the like. The module it will be seen then is preferably mounted within a hollow wall and will be covered over by the wall layer such as wall board 17, paneling or the like. It also could be inset in a masonry structure. In its mounting, the module front side access opening 18 will be situated at the wall surface, that surface having a cut out made therein as is customary with outlet box installation. Hookup of all electrical conduit(s), wiring, outlet mountings in the module etc. will preferably have been made before wall finishing is undertaken.

Figure 3:
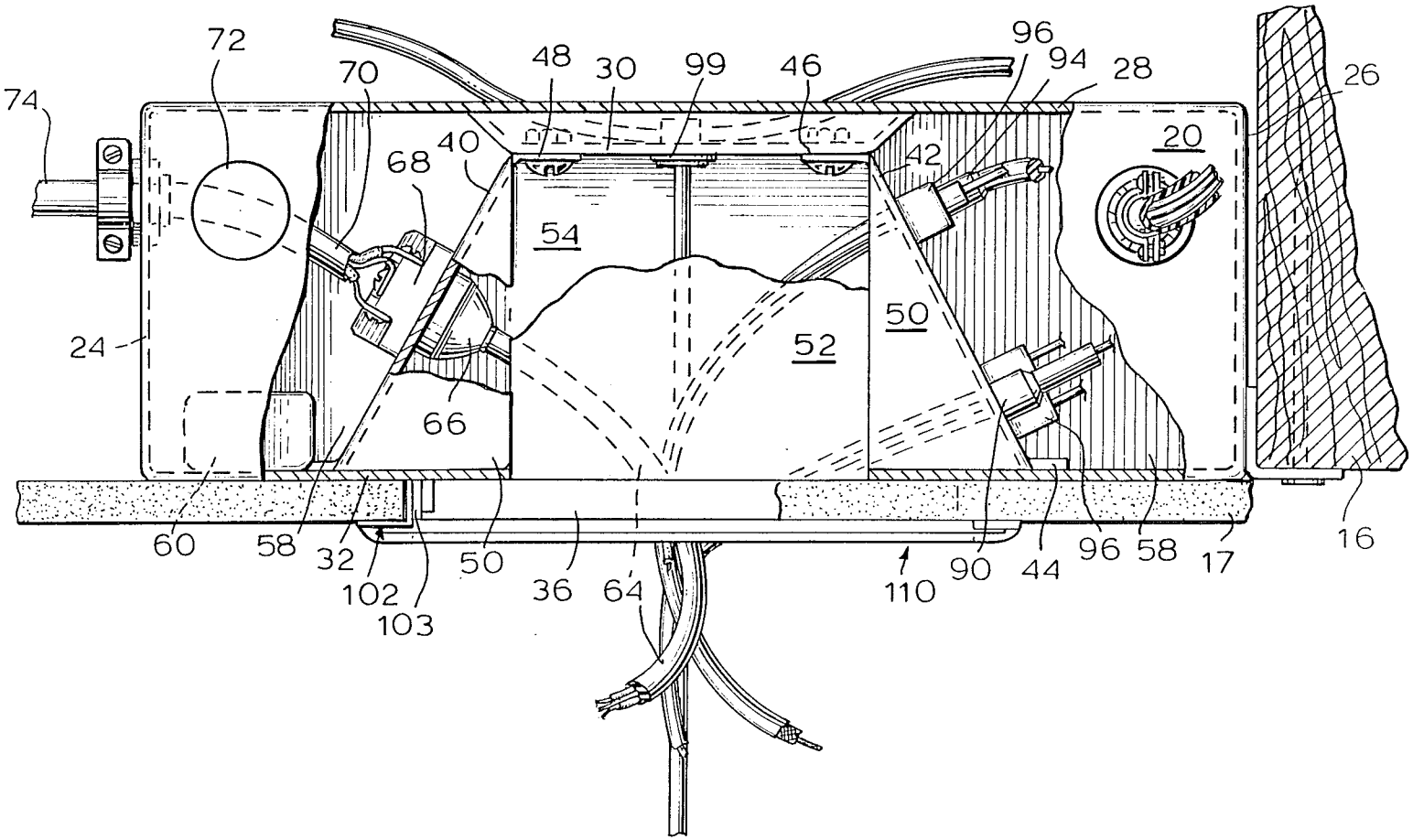
FIG. 3 is a top plan view of the module with parts of the top wall thereof broken away to show housing constructional details.
Figure 4:
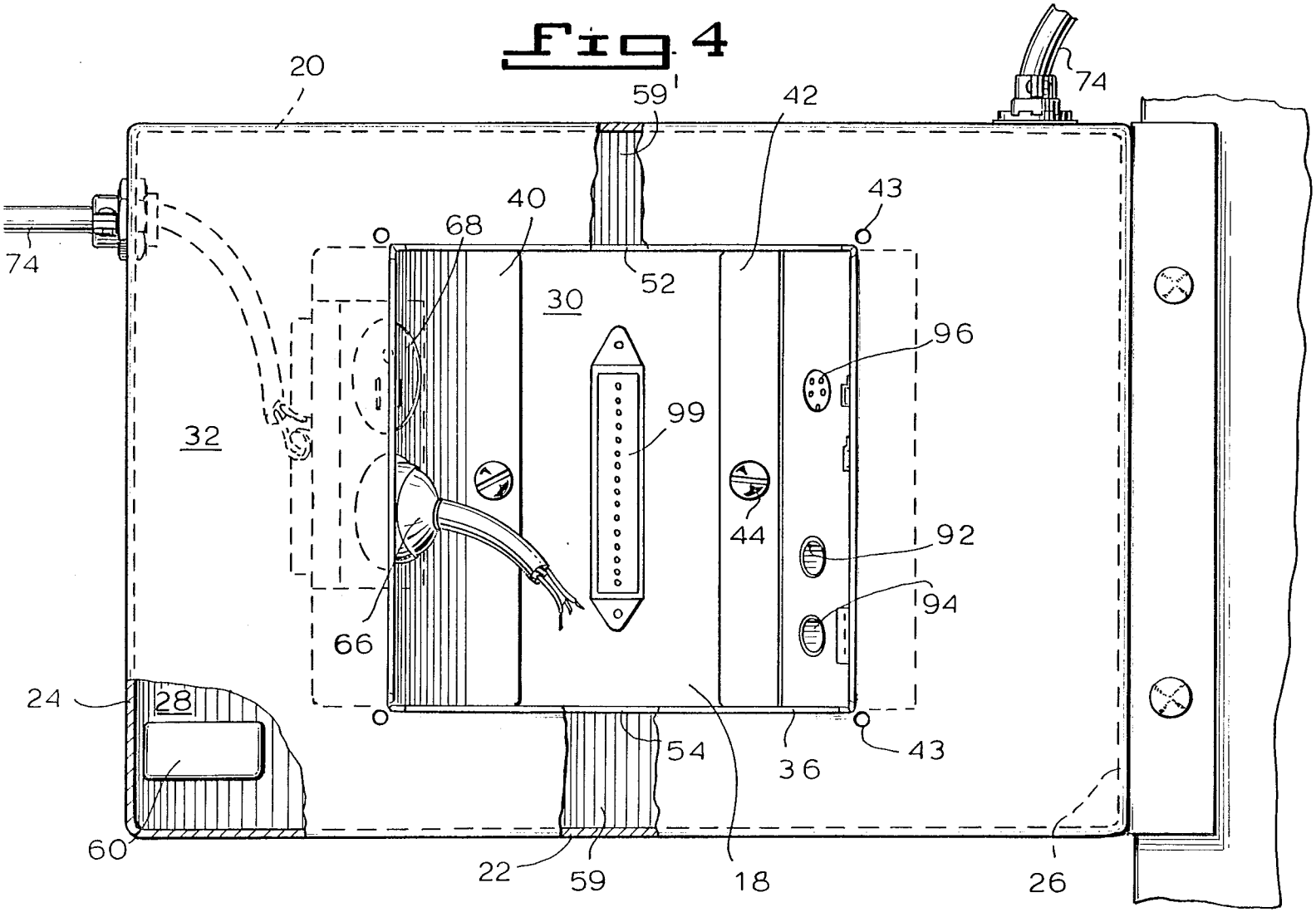
FIG. 4 is a front elevational view of the module with portions of the front wall broken away and particularly illustrating the manner in which the outlet receptacles are arranged on the mounting plates therefor which are carried in the housing.

The housing 12 and with reference additionally being made to FIGS. 3 and 4, has a top wall 20, a bottom wall 22 and end walls 24, 26 which walls together constitute an encircling wall structure defining the length, width and depth expanse of the housing, the housing further having a rear wall 28 with an indented panel part 30 and a front wall 32 which is provided with the access opening 18, the front wall including forwardly extending flange parts 36 which demark the marginal expanse of the access opening 18. Access opening 18 provides entry to a central part or chamber within the housing spaces and which will be described more fully next.

A pair of mounting plates 40, 42 are fixed within the housing, each of said plates having an end thereof connected to the housing wall 32 as at 44 adjacent one of the side margins of access opening 18. The mounting plates extend rearwardly in the housing from such connection locations in mutually converging courses to termination near the housing rear side where they are joined to indented panel part 30 as at 46, the said connections being effected with tab or flange like extensions 48 provided at the ends of the mounting plates. The mounting plates also include upper and lower triangular shaped flanges 50, and separate upper plate member 52 and lower plate member 54 are positioned at the respective tops and bottoms of the mounting plates so that these components, i.e., the mounting plates 40, 42 and plate members 52, 54 define the housing central chamber and there remains other spaces or voids in the housing as at 58 and 59, 59'. These voids 58, 59, 59' provide space for electrical wiring connections as will be described later as well as accommodation of wire transit from side to side in the box and for reception of certain components 60 used in connection with particular ones of the electrical services capacities associated with the module, such components including, e.g., transformers, solid state amplifiers etc.

The mounting plates 40, 42 serve as the structure for carrying a plurality of diverse electrical service outlet receptacles. These receptacles can include, by way of example, those used to receive the cable connectors associated with high voltage power supply, ribbon wires, telephone service, radio wave signal reception, coaxial cable service etc. FIGS. 3 and 4 show a representative arrangement of such receptacles. It will be seen each receptacle is in a facing, readily viewable relationship with but recessed inwardly of the access opening 18 so that the cable connectors,e.g., high voltage power supply cable 64 and its connector or plug 66 easily can be inserted through the access opening and mounted or received in one of the power receptacles 68 on mounting plate 40. The body of each receptacle is of course disposed in one of the housing voids and the wiring connection 70 at the rear of each receptacle can pass out of the housing, through knock-out type openings 72 therein (FIG. 3), in courses 74 (FIGS. 1 and 2) leading to particular electrical systems source locations, the cables being housed within conduits 75 (FIGS. 1 and 2) as required and/or desired.

FIGS. 3 and 4 show receptacle arrangements consonant with the advantage gained by arranging the receptacles in at least two groups thereof to maximize the number of such receptacles which can be carried in the module as well as the grouping of same in a manner as facilitates the user making required connection. For example, high voltage power supply outlet 68 needs may predominate in which case the several ones of such outlet types will constitute one group exclusively, of all outlets located on one of the mounting plates, viz., plate 40. This simplifies initial hookup and the user knows that power plug insertion is made at the left side of the access opening 18. The other mounting plate 42 can be used for other types of service needs. Thus it may carry telephone service outlets 90, an outlet 92 for television antenna connection, a jack type outlet 94 for audio speaker service, an outlet 96 for pin connector service etc. A further outlet mounting availability is provided on indented panel part 30 at the rear of the central chamber where a ribbon connector outlet 99 for computer tie-in or dwelling security system can be located.

FIG. 5a shows a retainer plate 102 designed to fit encirclingly around access opening 18 with its flanges 103 nested interiorly alongside housing flanges 36 and be secured by screws 102 to the housing front wall with the wall board 17 that abuts with flange parts 36 sandwiched therebetween, the screws passing through plate flanges 105 and then being received in threaded openings 43 in the housing front wall (FIG. 4). This component neatly squares off the appearance of the housing installation in the wall environment, and solidly clamps the housing to the wall board/wall lining. The retainer plate placement in this respect can be seen further with reference to FIGS. 6–8. The plate 102 as will be understood from reference to both FIG. 5*a* and 8, is provided with a flange or saddle 125 formed therein as by striking up a segment from the lower flange 103 of the plate at a suitable slope. This saddle 125 cooperates with a received closure plate 110a of the FIG. 5*c* construction to block viewing of the interior of the housing cavity through opening 116 in the cover plate.

For aesthetic and safety purposes various forms of closure plates can be used to close-off the module access opening 18. Representative forms of such closure plates are those shown in FIGS. 5*b*–5*d*. FIG. 5*b* shows such a closure plate 110 which can be used in the instance where no cable connectors are inserted in the module and it is desired to close off the opening thereto for appearance sake or as a safety measure to prevent small children from having access to high voltage potential sources. The closure plate 110 can be removably connected in close-off position in various ways. For example, it can have rear side spring prongs 112 as shown in FIG. 6 which exert bias and engage adjacent structure of the wall board and/or retainer plate 102 to secure the closure plate in place.

If it is desired to use a closure plate when cable connectors are inserted in the module, the closure plate 110*a* shown in FIG. 5*c* will be used or that 118 shown inFIG. 5*d* can be used and each will be provided with a marginal recess as at 116 to accommodate the cable pass through while at the same time minimize the extent of the access opening.

FIGS. 5*d* and 7 depict another form of closure plate 118 which embodies a key lock cylinder 120 on a shaft with an anchor arm 122 that can engage structure behind the access opening to hold the plate securely locked over the opening.

With regard to the construction of the module housing 12, it will be appreciated that it can be fabricated in various ways and with various materials. For example, it could be made of metal sheet in several housing parts and these could be secured together in desired configuration by spot welding, screw fastening at companion tabs etc. It also could be made of molded plastic components or of a combination of metal and plastic pieces.

While there is above disclosed only certain embodiments of the multi-service electrical outlet model of the invention it will be appreciated that variations and modifications can be made thereto by those skilled in the art without departing from the scope of the inventive concept disclosed.

What is claimed is:

1. A multi-service electrical outlet module comprising:

a housing including a front wall having an access opening therein, a back wall, and an encircling side wall structure interposed between said front wall and said back wall to define an interior housing space;

at least one mounting structure disposed in said housing and each spaced inwardly a distance from said access opening so as to form a recessed cavity within said interior housing space, said mounting structure having an outer surface portion exposed to said access opening and an inner surface portion facing said walls of said housing, said mounting structure being interconnected to said housing and being spaced from said walls in a manner to provide at least one enclosed interior space formed between said inner surface portions of said walls of said housing and said mounting structure;

at least two spaced-apart discrete groups of aperture means on said mounting structure, each group being adapted to receive a plurality of diverse-service electrical outlet receptacles; and means in said walls of said housing to permit passage of electrical cable therethrough and for interconnection thereof with receptacles on said mounting structure, at least some of said aperture means of the first group being located adjacent one of two opposite ends of said access opening, and said aperture means of the second group being located adjacent the other end of said access opening.

2. The electrical outlet module of claim 1 in which said aperture means are arranged in first and second receptacle groups on said mounting structure, each group being disposed adjacent one of said two access opening ends.

3. The electrical outlet module of claim 2 in which at least one of said aperture means in one of said groups is associated with a service different than that associated with at least one other of said aperture means in said one group.

4. The electrical outlet module of claim 2 in which at least one of said aperture means in one of said groups is associated with a service different than that associated with at least one of said aperture means in the other group.

5. The electrical outlet module of claim 2 in which said aperture means include ones for reception of connectors associated with high voltage power supply, ribbon wires, telephone service, radio wave signal reception and coaxial cable service.

6. The electrical outlet module of claim 5 in which said aperture means for receptacles associated with high voltage power supply are all arranged in one of said receptacle groups.

7. The electrical outlet module of claim 5 in which said aperture means for receptacles in said one receptacle group are exclusively ones associated with high voltage power supply.

8. The electrical outlet module of claim 2 in which said encircling side wall structure defines housing length, depth and width expanses, and said access opening has margins spaced a distance from the depth and length expanses of said housing.

9. The electrical outlet module of claim 8 in which there are two mounting structures, each of said mounting structures extending from adjacent one of said two opposite access opening ends rearwardly within said housing and in converging course with another receptacle mounting structure, whereby said two mounting structures define said recessed cavity of said housing.

10. The electrical outlet module of claim 9 in which the rearwardly located extremes of said mounting structures are connected by a panel member.

11. The electrical outlet module of claim 8 in which said housing includes means thereon for mounting said housing in an in-use environment location.

12. The electrical outlet module of claim 11 in which said housing mounting means comprises tab extensions carried on said housing for engaging a support member at said in-use environment location, the said tab extensions accommodating passing through of fasteners employed to secure said housing to said support members.

13. The electrical outlet module of claim 8 further comprising a closure plate removably secured to said housing in covering position over said access opening.

14. The electrical outlet module of claim 13 in which said closure plate has a marginal recess therein for accommodating pass through of electrical service cables into said housing at a common entry point, said closure plate otherwise preventing access to said housing.

15. An electrical outlet module which comprises means defining a space enclosing housing having an access opening therein, and a plurality of diverse electrical service outlet receptacles disposed in said housing and each spaced inwardly a distance from said opening, each outlet receptacle having a facing relationship with said access opening for receiving the connector plug of an electrical service cable passed through said access opening, at least some of the plurality of such outlet receptacles being arranged in at least one discrete receptacle group located adjacent one of two opposite ends of said access opening, said receptacles in said plurality being arranged in first and second receptacle groups, each group being disposed adjacent one of said two access opening ends, said housing including encircling wall structure defining housing length, depth and width expanses, and front and rear wall members connected to said encircling wall structure, said access opening being in said front wall member and having margins spaced a distance from the depth and length expanses of said housing, said outlet receptacles being carried on plates fixed in said housing, said module further including a pair of outlet carrying plates associated one each with one of said receptacle groups, each of said outlet carrying plates extending from adjacent one of said two opposite access opening ends rearwardly within the housing and in converging course with the other plate, the said two plates defining a central chamber portion fo said housing, the rearwardly located extremes of said outlet carrying plates being connected by a panel member, said panel member carrying additional electrical service outlet receptacle means.

16. The electrical outlet module of claim 15 in which said additional outlet receptacle means comprises an outlet receptacle for service different than that associated with each of the receptacles in said first and second receptacle groups.

17. The electrical outlet module of claim 16 in which said additional outlet receptacle is one associated with reception of a ribbon wire connector.

18. an electrical outlet module which comprises:

means defining a space enclosing housing having an access opening therein, and a plurality of diverse electrical service outlet receptacles disposed in said housing and each spaced inwardly a distance from said opening, each outlet receptacle having a facing relationship with said access opening for receiving the connector plug of an electrical service cable passed through said access opening, at least some of the plurality of such outlet receptacles being arranged in at least one discrete receptacle group located adjacent one of two opposite ends of said access opening, said receptacles in said plurality being arranged in first and second receptacle groups, each group being disposed adjacent one of said two access opening ends, said housing including encircling wall structure defining housing length, depth and width expanses, and front and rear wall members connected to said encircling wall structure, said access opening being in said front wall member and having margins spaced a distance from the depth and length expanses of said housing, said outlet receptacles being carried on plates fixed in said housing, said module further including a pair of outlet carrying plates associated one each with one of said receptacle groups, each of said outlet carrying plates extending from adjacent one of said two opposite access opening ends rearwardly within said housing and in converging course with the other plate, said two plates defining a central chamber portion of said housing wherein the interior space of said housing additional to said central chamber portion is sufficiently large to accommodate installation therein of transformers and amplifiers associated with particular ones of said electrical service outlet receptacles.

19. A multi-service electrical outlet box, which comprises:

(a) a housing having a front wall and a back wall, and side walls interposed between said front wall and said back wall and joined thereto to define an interior housing space, said front wall having an access opening formed therethrough;

(b) at least two receptacle mounting structures being arranged within the interior housing space so as to be exposed to said access opening, each said mounting structure having an outer surface portion exposed to said access opening and an inner surface portion facing said walls of said housing, each said mounting structure being interconnected to said housing and being spaced from said walls in a manner to provide at least one enclosed interior space formed between the inner surface portions of said walls of said housing and respective mounting structures, said mounting structures being angularly oriented with respect to said access opening;

(c) aperture means on said mounting structures adapted to receive a plurality of diverse-service electrical outlet receptacles, (d) means in said walls of said housing to permit passage of electrical cable therethrough and for interconnection with receptacles on said mounting structures; and (e) the relative positioning and arrangement of said mounting structures in said housing forming a recessed cavity within said interior housing space and which is accessible through said access opening, said recessed cavity being of sufficient volume as to house connector plugs received in said electrical outlet receptacles.

20. The multi-service electrical outlet box of claim 19, wherein at least some of said aperture means in one said mounting structure are arranged in at least one discrete receptacle group located adjacent one of the two opposite ends of said access opening, and at least some of said aperture means in the other mounting structure are arranged in at least one discrete receptacle group located adjacent the other of the two opposite ends of said access opening.

21. the multi-service electrical outlet box of claim 19 wherein at least one of said aperture means in one of said groups is associated with a service different than that associated with at least one of said aperture means in the other of said groups.

22. The multi-service electrical outlet box of claim 19 which further comprises a closure plate removably securable to said housing and positionable to cover said access opening.

23. The multi-service electrical outlet box of claim 19 wherein the rearwardly located extremes of said mounting structures are connected with a rear mounting structure being disposed parallel to the plane of said access opening, said rear mounting structure having an aperture means for receiving at least one diverse service electrical outlet receptacle.

24. The multi-service electrical outlet box of claim 23, wherein said back wall has an access opening formed therein, and wherein a back recessed cavity is formed within said interior housing space by at least said rear mounting structure, and which is accessible through said back recessed cavity.

25. The multi-service electrical outlet box of claim 24 wherein said aperture means in said rear mounting structure is for receiving a ribbon wire connector.

* * * * *